US005579364A

United States Patent [19]

Osaka et al.

[11] Patent Number: 5,579,364

[45] Date of Patent: Nov. 26, 1996

[54] ROTATING-ANODE X-RAY TUBE

[75] Inventors: Naohisa Osaka, Oume; Toru Kobayashi, Hidaka, both of Japan

[73] Assignee: Rigaku Corporation, Tokyo, Japan

[21] Appl. No.: 376,877

[22] Filed: Jan. 23, 1995

[30] Foreign Application Priority Data

Jan. 28, 1994 [JP] Japan ..... 6-026376

[51] Int. Cl.[6] ..... H01J 35/18

[52] U.S. Cl. ..... 378/130; 378/127; 378/141

[58] Field of Search ..... 378/130, 144, 378/127, 132, 141, 125

[56] References Cited

U.S. PATENT DOCUMENTS

| | | | |
|---|---|---|---|
| 4,523,327 | 6/1985 | Eversole . | |
| 4,622,687 | 11/1986 | Whitaker et al. | 378/130 |
| 4,625,324 | 11/1986 | Blaskis et al. | 378/130 |
| 4,674,109 | 6/1987 | Ono | 378/130 |
| 5,077,781 | 12/1991 | Iversen . | |

FOREIGN PATENT DOCUMENTS

| | | |
|---|---|---|
| 0186937 | 7/1986 | European Pat. Off. . |
| 62-066545 | 3/1987 | Japan . |

*Primary Examiner*—David P. Porta

*Attorney, Agent, or Firm*—Frishauf, Holtz, Goodman, Langer & Chick

[57] ABSTRACT

A rotating-anode X-ray tube has a rotary pipe rotatably supported in a casing, and a target which is fixed to one end of the rotary pipe and can rotate along with the rotary pipe, the target being cooled by a flow of cooling fluid. A cooling-fluid sealing device is provided between the casing and the rotary pipe and is a mechanical seal. The mechanical seal has a rotary ring which is rotatable along with the rotary pipe and axially movable, a stationary ring fixed to the casing, and pressing means for pressing the rotary ring against the stationary ring. The rotary and the stationary rings come into surface contact with each other within a plane perpendicular to an axis of rotation. The rotary ring is made of carbon and the stationary ring is made of silicon carbide ceramics, both materials being electrically conductive.

11 Claims, 3 Drawing Sheets

ROTATING-ANODE X-RAY TUBE

BACKGROUND OF THE INVENTION

This invention relates to a rotating-anode X-ray tube having a rotating target whose inside is cooled by a flow of cooling fluid, and specifically to a cooling-fluid sealing device for the X-ray tube of this type.

In an X-ray tube, electrons are emitted from a cathode filament and collide against a target to generate X-rays along with a large quantity of heat on the surface of the target. Therefore, a high-power X-ray tube is provided with a rotating target whose inside is cooled by a flow of cooling water to avoid too heating of the target to an extremely high temperature.

Where the cooling water is used to cool the inside of the rotating target, the cooling water have to be sealed not to leak out of the cooling-water passage. A lip seal such as an oil seal and a V-seal has hitherto be used to prevent leakage of the cooling water. The lip seal has a lip made of rubber, silicone or the like. The lip seal comes into contact under pressure with an outer surface of the rotary shaft of the target so as to avoid leakage of the cooling water out of the cooling-water passage which is provided around the rotary shaft.

The lip seal, however, allows the cooling water to leak a bit because a thin oil film has to be formed between the lip and the rotary shaft to assure lubrication of the rotary shaft. Besides, it is difficult for the lip seal to seal entirely the cooling water because (1) the contact between the lip seal and the rotary shaft becomes line contact and (2) the contact pressure between the lip seal and the rotary shaft acts in the radial direction unevenly around the rotary shaft.

The rotating-anode X-ray tube has a cylindrical target which can rotate with a high speed such as of several thousand rpm. Under the high-speed condition, the lip seal is easy to get aged deterioration and the rotary shaft is easy to wear, so that the lip seal can not be used for a long time in a good condition.

BRIEF SUMMARY OF THE INVENTION

It is an object of the present invention to provide a rotating-anode X-ray tube which can prevent almost entirely leakage of the cooling fluid.

It is another object of the present invention to provide a rotating-anode X-ray tube having a cooling-fluid sealing device of a long life.

It is a further object of the present invention to provide a rotating-anode X-ray tube which can prevent stray current corrosion on the bearings.

A rotating-anode X-ray tube of the present invention comprises a tube shield whose inside can be evacuated to a vacuum; a casing mounted on the tube shield; a rotary pipe rotatably supported in the casing; a target which is fixed to one end of the rotary pipe and can rotate along with the rotary pipe; a cooling-fluid passage provided in the rotary pipe and in the target; and a cooling-fluid sealing device which is disposed between the casing and the rotary pipe and is a mechanical seal. The mechanical seal includes a rotary ring which is rotatable along with the rotary pipe and is movable axially; a stationary ring fixed to the casing; and pressing means for pressing the rotary ring against the stationary ring. The contact between the rotary ring and the stationary ring becomes surface contact within a plane perpendicular to the axis of rotation. The contact pressure between the rotary ring and the stationary ring acts not in the radial direction but in the thrust direction, so that the contact pressure acts uniformly over the contact surface. Pressure adjusting means may be provided for varying the pressure of the pressing means. Using the mechanical seal of this type as a cooling-fluid sealing device for the rotating-anode X-ray tube prevents almost entirely leakage of the cooling fluid and enables the cooling-fluid sealing device to have a long life.

The mechanical seal is made of electrically conductive materials so that electric conduction is completed between the rotary pipe and the casing through the mechanical seal. The electric conduction prevents stray current corrosion on the bearings. A preferable combination in material for the rotary and the stationary rings of the mechanical seal is a combination of carbon and silicon carbide ceramics.

Other features and advantages of the invention will be apparent from the following description taken in connection with the accompanying drawings.

DETAILED DESCRIPTION OF THE PREFERRED EMBODIMENTS

Figure 1:
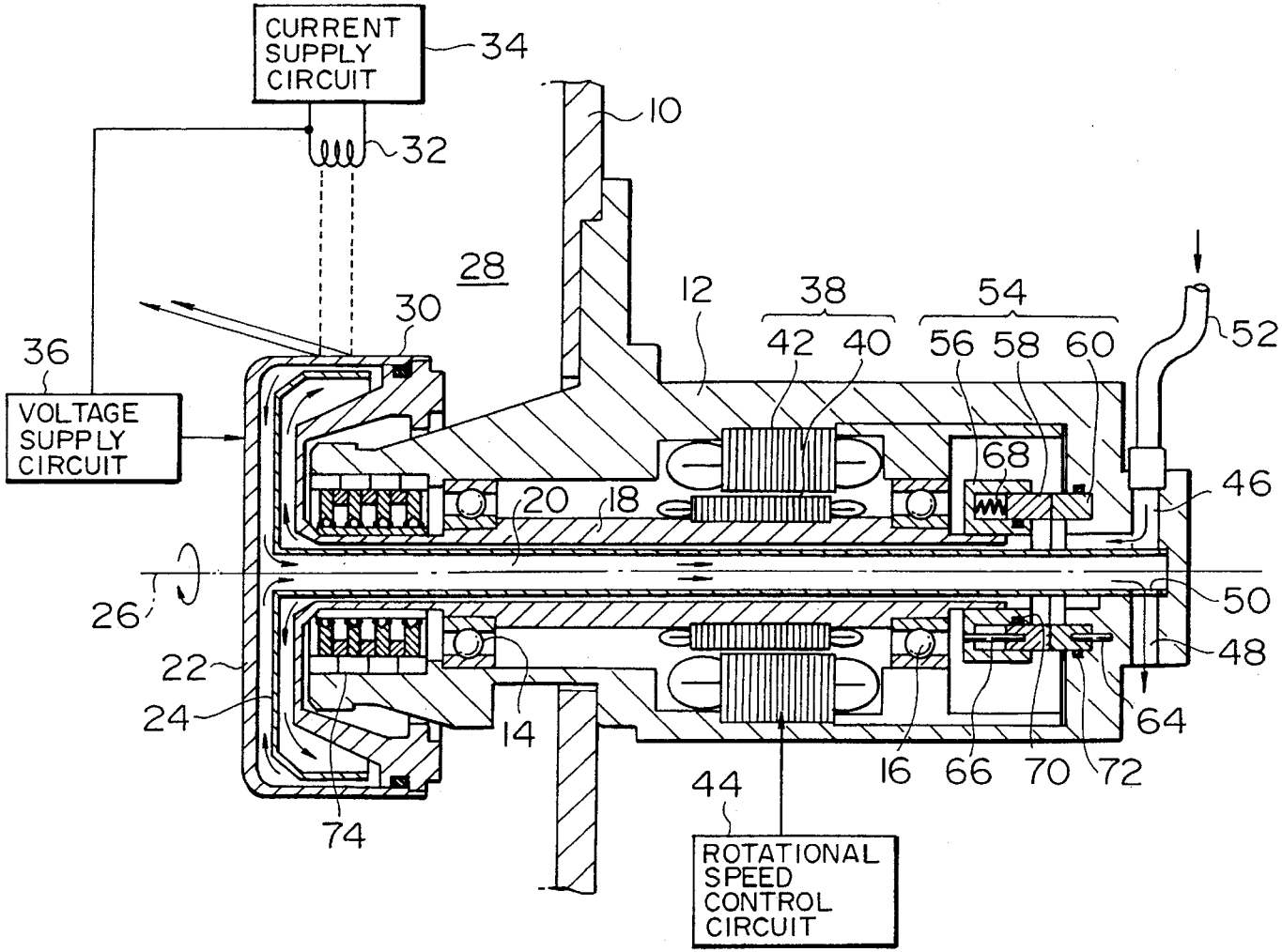
FIG. 1 is an axial sectional view of a preferred embodiment of a rotating-anode X-ray tube of the invention.

Referring to FIG. 1 illustrating one embodiment of a rotating-anode X-ray tube of the invention, the X-ray tube has a tube shield 10, a casing 12 mounted on the tube shield 10 by a fastening device like bolts, a hollow outer pipe 18 supported in the casing 12 through bearings 14, 16, and a hollow inner pipe 20 extending within the outer pipe 18. The outer pipe 18 can rotate around a center axis 26. On the other hand, the inner pipe 20 does not rotate because its right end is fixed to the casing 12. Near the left end of the casing 12, a magnetic fluid sealing device 74 is disposed as a vacuum seal between the outer pipe 18 and the casing 12.

A cylindrical target 22 is fixed to the left end of the outer pipe 18 to form one unit as a whole. To the left end of the inner pipe 20 is fixed a partition plate 24 dividing the inside space of the target 22 to define a flow passage. An inside space 28 of the tube shield 10 having the target 22 therein is airtightly isolated from outside and evacuated by a vacuum pump (not shown) to hold a vacuum condition. A cathode filament 32 is also disposed in the inside space 28, facing a cylindrical surface 30 of the target 22. The filament 32 is connected to a current supply circuit 34. A voltage supply circuit 36 is connected between the filament 32 and the target 22.

An alternating-current motor 38 is disposed, within the casing 12, between the two bearings 14, 16. The motor 38 is composed of a rotor 40 fixed to an outer peripheral surface of the outer pipe 18 and a stator 42 fixed to an inner peripheral surface of the casing 12. The motor 38 is connected to a rotational speed control circuit 44 so that the rotor 40 and thus the outer pipe 18 can rotate with a predetermined speed.

The casing 12 has at its right end a cooling-water inlet 46 and a cooling-water outlet 48. The cooling-water outlet 48 communicates with an opening 50 provided at the right end of the inner pipe 20. A cooling-water passage starting from the cooling-water inlet 46 to the cooling-water outlet 48 is composed of a gap defined between an inner surface of the outer pipe 18 and an outer surface of the inner pipe 20, a passage defined by the partition plate 24 within the target 22, and an inside space of the inner pipe 20. The cooling water is supplied via a water conduit 52 connected to the cooling-water inlet 46 and flows in the above-mentioned cooling-water passage to cool the target 22 from inside. The flow direction of water shown in the drawing may be reversed.

A cooling-fluid sealing device 54 is provided near the right end of the inside space of the casing 12 to prevent leakage of the cooling water. The sealing device 54 has, as well shown in FIG. 2, a housing 56, a rotary ring 58 and a stationary ring 60. The housing 56 has an annular recess 62. The rotary ring 58 is partly inserted into the recess 62 and can move axially.

Figure 2:
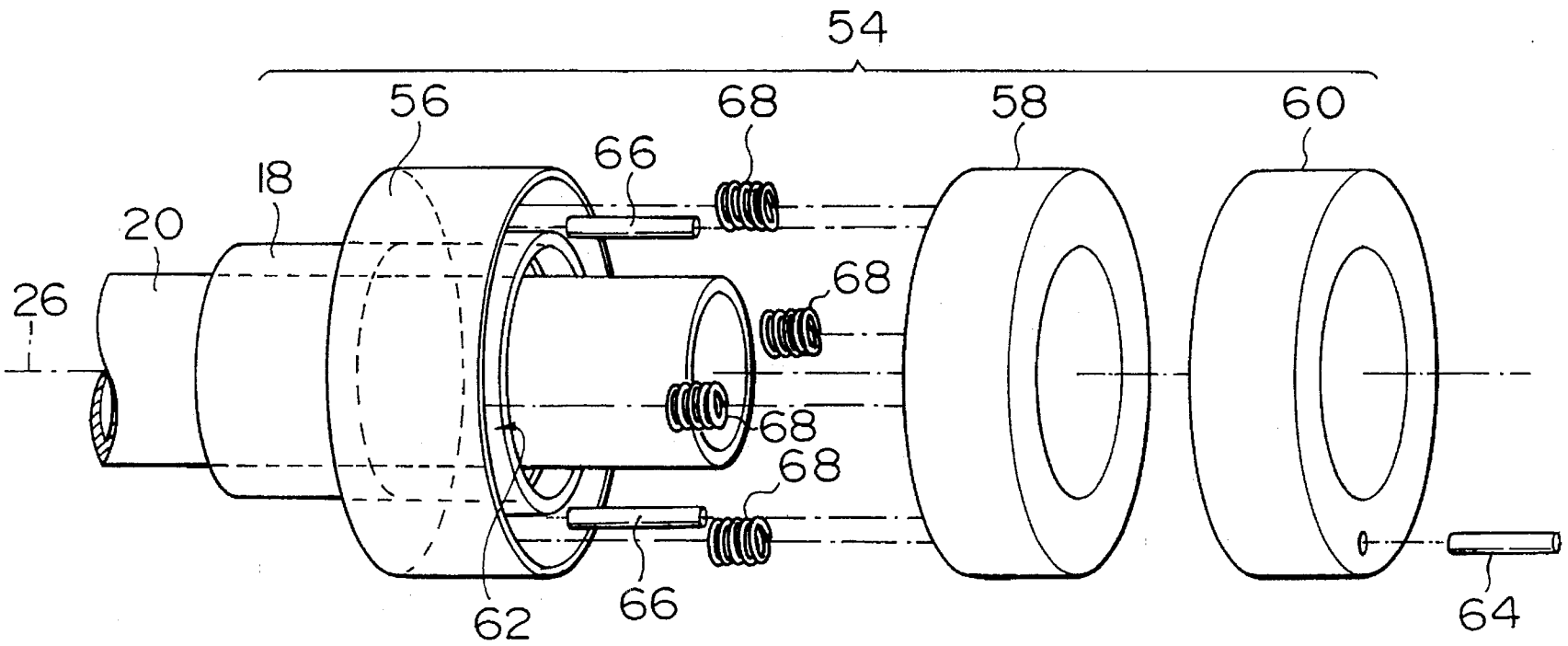
FIG. 2 is an exploded perspective view of a cooling-fluid sealing device of the X-ray tube shown in FIG. 1.

The housing 56 is fixed to the outer peripheral surface of the outer pipe 18 and rotates along with the outer pipe 18. The stationary ring 60 is, as shown in FIG. 1, mounted on the right end of the casing 12 and held in position by a pin 64 not to rotate. Referring to FIG. 2, the rotary ring 58 and the housing 56 are coupled with each other through two pins 66 which act as a whirl-stop, so that relative rotation is prevented between the rotary ring 58 and the housing 56. Between the rotary ring 58 and the housing 56 is disposed four compression coil springs 68 which act as pressing means. The rotary ring 58 comes into surface contact under pressure with the stationary ring 60 by a spring force of the springs 68. The contact surface therebetween can seal the cooling water.

The rotary ring 58 is made of carbon, and the stationary ring 60 is made of silicon carbide ceramics. This combination of the relatively hard material (silicon carbide) and the relatively soft material (carbon) improves a sealing performance. Referring back to FIG. 1, an O-ring 70 is disposed between the rotary ring 58 and the housing 56, and another O-ring 72 is disposed between the stationary ring 60 and the casing 12. These O-rings 70, 72 are used for sealing water.

The operation of the embodiment of the rotating-anode X-ray tube described above will now be explained. The motor 38 gives the target 22 a high-speed rotation such as of several thousand rpm around the center axis 26. The cooling water supplied from the water conduit 52 through the cooling-water inlet 46 flows inside the target 22 to cool it and is discharged out of the cooling-water outlet 48. Under the condition, the current supply circuit 34 gives a current to the filament 32 so that hot electrons are emitted therefrom. The hot electrons are accelerated by as O-called tube voltage which is a voltage applied between the filament 32 and the target 22 by the voltage supply circuit 36, so that the hot electrons collide against the outer peripheral surface 30 of the target 22 to generate X-rays from a focus area, i.e. the electron collision area. The X-rays are taken out of a beryllium window (not shown) which is provided at a pertinent site on the tube shield 10, the X-rays being used for various kinds of X-ray related apparatus. The high-speed rotation of the target 22 and also the cooling thereof prevent too heating of the target 22 to an extremely high temperature which is caused by the electron collision.

When the target 22 and thus the outer pipe 18 rotate, the housing 56 and thus the rotary ring 58 of the cooling-fluid sealing device 54 also rotate. Therefore, the rotary ring 58 slides over the stationary ring 60 with surface contact under pressure by a pressing force of the springs 68. The surface contact can prevent leakage of the cooling water out of the cooling-water passage into a space in which the motor 38 and the bearings 14, 16 are arranged.

The contact pressure between the rings 58, 60 is held uniformly over the contact surface because (1) the contact becomes surface contact and (2) the contact pressure acts not in the radial direction but in the axial direction of the outer pipe 18. As a result, leakage of the cooling water is prevented almost entirely. Besides, the sealing device 54 has a long life because the contact between the rings 58, 60 is held in a good condition for a long time by means of the pressing force of the springs 68.

The working test of the sealing device 54 was performed in a following condition and no leakage was found.

(1) Contact Area between Rings 58, 60:
two kinds, 39 $cm^2$ and 23 $cm^2$, were prepared;

(2) Peripheral Speed of Target 22:
8–12 meters/sec;

(3) Cooling Water Pressure:
1 $kgf/cm^2$;

(4) Cooling Water Flow Rate:
about 13 liters/min;

(5) Running Time:
10,000 hours.

Figure 3:
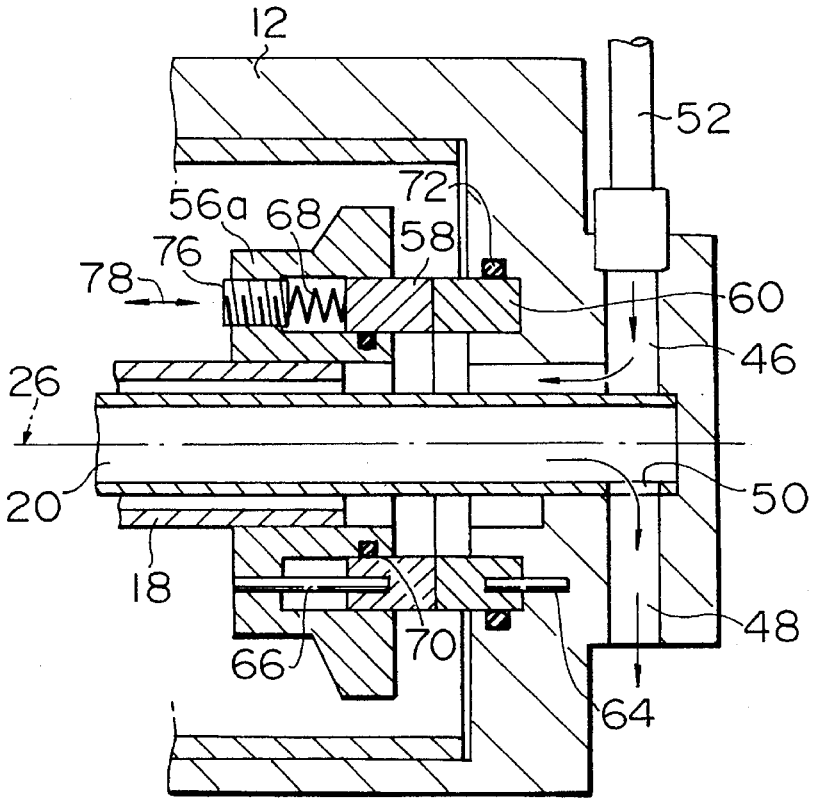
FIG. 3 is an axial sectional view of a cooling-fluid sealing device of a second embodiment of the invention.
Figure 4:
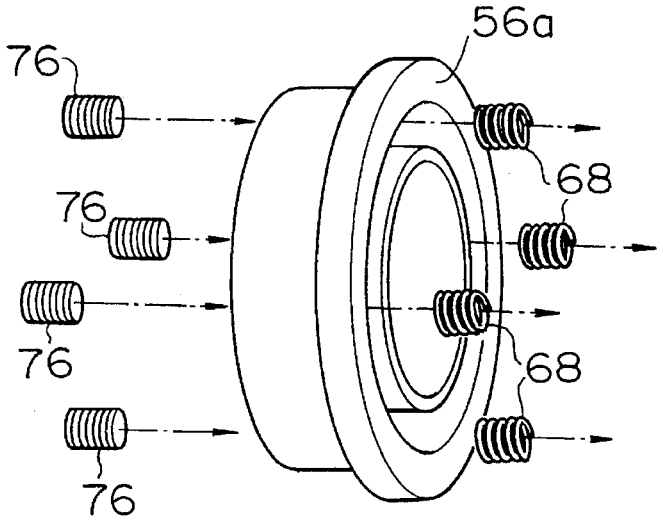
FIG. 4 is an exploded perspective view of the cooling-fluid sealing device shown in FIG. 3.

FIG. 3 illustrates a cooling-fluid sealing device in a second embodiment of the invention. The embodiment is characterized in that a pressure adjusting device is provided for varying a pressure applied between the rotary ring and the stationary ring. The pressure adjusting device has four adjusting screws 76 which are engaged at their threaded portions with the bottom of the housing 56*a*. The four adjusting screws 76, as well shown in FIG. 4, correspond to the four springs 68, the tip of each screw 76 coming into contact with the base end of each spring 68. It is noted in FIG. 3 that like elements are given like reference numerals shown in FIG. 1.

In this second embodiment, the adjusting screws 76 are turned to be moved parallel to the center axis 26 as shown by an arrow 78 in FIG. 3 so that the pressing force of the springs 68 can be adjusted, and therefore the contact pressure between the rotary ring 58 and the stationary ring 60 can be adjusted. Using this pressure adjusting device, the contact pressure between the rings 58, 60 can readily be adjusted depending on various conditions such as the kind of the cooling fluid, materials of the rotary and the stationary rings, and a rotational speed of the target. In other words, the optimum sealing condition can easily be set.

The embodiments described above and shown in the drawings may be changed. For example, the springs 68 may be arranged next to the stationary ring 60 so that the stationary ring 60 is pressed against the rotary ring 58. The pressing means for applying a pressing force between the rings 58, 60 may be, other than the springs 68, an air pressure, a water pressure and an oil pressure.

The whirl-stop mechanism for the rotary ring 58 may be, other than the pins 66, a key mechanism or the like. The whirl-stop mechanism for the stationary ring 60 may be, other than the pin 64, welding, bonding, magnetic locking, press-fitting and centrifugal locking.

The O-rings 70, 72 for sealing water at the rotary ring 58 and the stationary ring 60 may be arranged on any surface, i.e. on outer or inner peripheral surfaces of the rotary ring 58 and the stationary ring 60. Water sealing packing may be used in place of the O-rings 70, 72. The shapes of the contact regions of the rotary ring 58 and the stationary ring 60 are not limited to the flat surfaces as shown in the drawings and may be of any shape.

The materials for the rotary ring 58 and the stationary ring 60 are, as described above, a combination of carbon and silicon carbide ceramics, the selected combination having the feature that (1) it is a combination of soft and hard materials and (2) both materials are electrically conductive. Therefore, electric conduction is completed between the outer pipe 18 and the casing 12 through the cooling-fluid sealing device 54. The conductive sealing device 54 can prevent the stray current corrosion on the bearings 14, 16 which are disposed between the outer pipe 18 and the casing 12. Stating in detail, the current is transmitted through not the bearings 14, 16 but the cooling-fluid sealing device so that the stray current corrosion on the bearings is prevented. As a result, the bearings are given increased stability and a long life.

Although the invention has been described in its preferred form; it is to be understood that the invention is not limited to the specific embodiments and the present disclosure may be changed without departing from the spirit and the scope of the appended claims.

What is claimed is:

1. A rotating-anode X-ray tube comprising:

a tube shield having an inside which can be evacuated to a vacuum;

a casing mounted on the tube shield;

a rotary pipe rotatably supported in the casing;

a target which is fixed to one end of the rotary pipe and which is rotatable along with the rotary pipe;

a cooling-fluid passage provided in the rotary pipe and in, the target;

a cooling-fluid sealing device disposed between the casing and the rotary pipe;

wherein said cooling-fluid sealing device comprises a mechanical seal which includes:

a rotary ring which is rotatable along with the rotary pipe and which is movable axially of the rotary pipe;

a stationary ring fixed to the casing; and pressing means for pressing the rotary ring against the stationary ring;

a housing fixed to the rotary pipe, the housing having an annular recess, and wherein the rotary ring is partly inserted into the annular recess so as to be axially movable; and a whirl-stop provided between the housing and the rotary ring to prevent a relative rotation therebetween; and wherein the pressing means is provided between the housing and the rotary ring.

2. A rotating-anode X-ray tube as claimed in claim 1, wherein said rotary ring and said stationary ring come into surface contact with each other within a plane perpendicular to an axis of rotation of said rotary ring.

3. A rotating-anode X-ray tube as claimed in claim 1, wherein said cooling-fluid sealing device further includes pressure adjusting means for varying a pressing force of the pressing means.

4. A rotating-anode X-ray tube as claimed in claim 1, wherein said mechanical seal is made of conductive materials so that electrical conduction is completed between the rotary pipe and the casing through the mechanical seal.

5. A rotating-anode X-ray tube as claimed in claim 4, wherein the materials of the rotary ring and the stationary ring of the mechanical seal are a combination of carbon and silicon carbide ceramics.

6. A rotating-anode X-ray tube comprising:

a tube shield having an inside which can be evacuated to a vacuum;

a casing mounted on the tube shield;

a rotary pipe rotatably supported in the casing;

a target which is fixed to one end of the rotary pipe and which is rotatable along with the rotary pipe;

a cooling-fluid passage provided in the rotary pipe and in the target; and a cooling-fluid sealing device disposed between the casing and the rotary pipe; and wherein said cooling-fluid sealing device comprises a mechanical seal which includes:

a rotary ring which is rotatable along with the rotary pipe and which is movable axially of the rotary pipe;

a stationary ring fixed to the casing;

pressing means for pressing the rotary ring against the stationary ring; and pressure adjusting means for varying a pressing force of the pressing means.

7. A rotating-anode X-ray tube as claimed in claim 6, wherein said rotary ring and said stationary ring come into surface contact with each other within a plane perpendicular to an axis of rotation of said rotary ring.

8. A rotating-anode X-ray tube as claimed in claim 6, wherein said mechanical seal is made of conductive materials so that electrical conduction is completed between the rotary pipe and the casing through the mechanical seal.

9. A rotating-anode X-ray tube as claimed in claim 8, wherein the materials of the rotary ring and the stationary ring of the mechanical seal are a combination of carbon and silicon carbide ceramics.

10. A rotating-anode X-ray tube comprising:

a tube shield having an inside which can be evacuated to a vacuum;

a casing mounted on the tube shield;

a rotary pipe rotatably supported in the casing;

a target which is fixed to one end of the rotary pipe and which is rotatable along with the rotary pipe;

a cooling-fluid passage provided in the rotary pipe and in the target; and a cooling-fluid sealing device disposed between the casing and the rotary pipe;

said cooling-fluid sealing device comprising a said mechanical seal made of conductive materials so that electrical conduction is completed between the rotary pipe and the casing through the mechanical seal.

11. A rotating-anode X-ray tube as claimed in claim 10, wherein the materials of the rotary ring and the stationary ring of the mechanical seal are a combination of carbon and silicon carbide ceramics.

* * * * *